US005439713A

United States Patent [19]

Yamaoka et al.

[11] Patent Number: 5,439,713

[45] Date of Patent: Aug. 8, 1995

[54] STEEL WIRE COATED WITH FE-ZN-AL ALLOYS AND METHOD FOR PRODUCING THE SAME

[75] Inventors: Yukio Yamaoka; Tetsuro Noma, both of Amagasaki, Japan

[73] Assignee: Shinko Kosen Kogyo Kabushiki Kaisha, Hyogo, Japan

[21] Appl. No.: 236,435

[22] Filed: May 2, 1994

[30] Foreign Application Priority Data

Oct. 8, 1993 [JP] Japan ..... 5-253365

[51] Int. Cl.[6] ..... C23C 2/06

[52] U.S. Cl. ..... 427/433; 427/406

[58] Field of Search ..... 427/406, 433

[56] References Cited

U.S. PATENT DOCUMENTS 4,171,394 10/1979 Patil ..... 427/433
4,361,448 11/1982 Sippola ..... 427/433
4,390,377 6/1983 Hogg ..... 427/433

FOREIGN PATENT DOCUMENTS 1295361 12/1986 Japan ..... 427/433

*Primary Examiner*—Sam Silverberg
*Attorney, Agent, or Firm*—Jordan and Hamburg

[57] ABSTRACT

A steel wire is coated with a ternary alloy of iron, zinc and aluminum on an outermost surface thereof. The ternary alloy contains 10 to 30 weight percent of aluminum. The steel wire is primarily used as material for springs. An Fe—Zn—Al ternary alloy coated steel wire production method includes immersing a steel wire in a zinc molten bath to plate the steel wire with zinc; immersing the zinc-plated steel wire in a zinc-aluminum molten bath to form a ternary alloy of iron, zinc, and aluminum on a surface of the steel wire; and removing an unsolidified zinc-aluminum layer depositing on an outer surface of the steel wire while being taken out of the zinc-aluminum molten bath to expose the ternary alloy on an outermost surface of the steel wire.

4 Claims, 3 Drawing Sheets

STEEL WIRE COATED WITH FE-ZN-AL ALLOYS AND METHOD FOR PRODUCING THE SAME

BACKGROUND OF THE INVENTION

This invention relates to steel wires formed with an alloy coating and a method for producing the same, particularly relates to an iron-zinc-aluminum alloy coated spring steel wires and method for producing the same.

Steel wires for springs have been required, except for valve springs for use in an automotive vehicle, to principally have:

(1) High formability, and (2) High corrosion resistance.

Conventionally, the following spring steel wires have been practically used.

AISI304 STAINLESS STEEL WIRE FOR SPRING: This wire is produced by drawing a AISI304 wire.

ZINC-PLATED STEEL WIRE FOR SPRING: This wire is produced by plating a high carbon spring steel wire or piano wire with zinc and drawing the zinc-plated steel wire, or alternatively drawing a high carbon spring steel wire and plating the drawn spring steel wire with zinc.

IRON-ZINC ALLOY COATED STEEL WIRE FOR SPRING: This wire is produced by forming a steel wire with an iron-zinc alloy coating. The production of this wire is described in Japanese Examined Patent Publication No. 55-37590.

HIGH CARBON STEEL WIRE FOR SPRING: This wire is also called PIANO or MUSIC WIRE, and is widely used for springs. This wire has 0.60 to 0.95 weight percent carbon and a high tensile strength. According to JIS (Japanese Industrial Standards), there are provided ten or more classes for high carbon spring steel wires in the above-mentioned range of carbon content. Besides carbon, this wire contains 0.12 to 0.32 weight percent silicon, 0.30 to 0.90 weight percent manganese, and a negligible amount of phosphorus, sulfur, copper and the like.

These spring steel wires have the following disadvantages and do not satisfy completely the aforementioned Requirements (1) and (2), i.e., the formability and corrosion resistance.

AISI304 STAINLESS STEEL WIRE FOR SPRING: This wire is excellent in corrosion resistance, but poor in formability in that there are variations in length of formed coil springs. Accordingly, this spring wire does not satisfy Requirement (1).

ZINC-PLATED STEEL WIRE FOR SPRING: This wire is covered with a thick and soft zinc layer, which is likely to gall in spring forming, e.g., when forming into a coil spring. Accordingly, this wire has poor formability and thus is unsatisfactory for Requirement (1). In the aspect of corrosion resistance, this wire has relatively good resistance for red rust, but has poor resistance for white rust. This wire gathers white rust at an early stage. Thus, it cannot be said that this wire satisfies Requirement (2).

IRON-ZINC ALLOY COATED STEEL WIRE FOR SPRING: This wire is covered with an iron-zinc alloy coating, which reduces the friction coefficient between a machine tool and a surface of steel wire for spring when being formed into springs. Accordingly, this wire has an excellent formability and satisfies Requirement (1). However, this wire is plated with zinc to form the iron-zinc alloy coating on the surface thereof. The iron-zinc alloy coated wire is then drawn. In the drawing, cracking is likely to occur in the alloy coating, resulting in partial peel-off of the alloy coating. Thus, this wire has a poor corrosion resistance and does not satisfy Requirement (2).

HIGH CARBON STEEL WIRE FOR SPRING: This wire sufficiently retains lubricant used in spring forming on the surface thereof, and can accordingly maintain a required formability. However, this wire has a poor corrosion resistance since no metal coating is formed on the surface thereof, and therefore does not satisfy Requirement (2).

As described above, each one of the conventional spring steel wires has merits and demerits. No such steel wire has been available which satisfies both Requirement (1) of good formability and Requirement (2) of good corrosion resistance.

Further, a hot-dipped zinc-aluminum plated wire has been known which has an iron-zinc-aluminum alloy layer and zinc-aluminum alloy plating on the alloy layer. This wire has been used for normal use, such as chain link wire net for cultivating fish in the sea, core for aluminum cable steel reinforced, but not used for springs because of not satisfying Requirements (1) and (2).

SUMMARY OF THE INVENTION

In view of the above problems, it is an object of the present invention to provide an alloy coated steel wire which is excellent in both formability and corrosion resistance.

Also, it is an object of the present invention to provide a method for producing an alloy coated steel wire which has excellent formability and corrosion resistance.

The present invention is directed to a steel wire comprising a ternary alloy of iron, zinc and aluminum on an outermost surface thereof. The ternary alloy may contain 10 to 30 weight percent of aluminum. It may be preferable to use this steel wire as a material for spring.

Also, the present invention is directed to a method for producing a steel wire, comprising the steps of: immersing a steel wire in a zinc molten bath to plate the steel wire with zinc; immersing the zinc-plated steel wire in a zinc-aluminum molten bath to form a ternary alloy of iron, zinc, and aluminum on a surface of the steel wire; and removing an unsolidified zinc-aluminum layer deposit on an outer surface of the steel wire while taking the steel wire out of the zinc-aluminum molten bath to expose the ternary alloy on an outermost surface of the steel wire.

It may be preferable that the zinc-aluminum molten bath contains 2 to 5 weight percent of aluminum.

The unsolidified zinc-aluminum layer may be removed by wiping off the unsolidified zinc-aluminum layer with asbestos cloth.

It may be advantageous that the ternary alloy coated steel wire is further drawn into a thinner wire having a specified diameter after the unsolidified zinc-aluminum layer is removed.

Further, the zinc-plated steel wire may be further drawn into a thinner wire having a specified diameter before the zinc-plated steel wire is immersed in the zinc-aluminum molten bath.

The alloy coated steel wire according to the invention coated with a ternary alloy of iron, zinc and aluminum, unlike the conventional steel wires coated with a binary alloy of iron and zinc. Since this alloy contains aluminum, a fine aluminum hydroxide layer is formed on the surface of the alloy coated steel wire and coats the entire surface of the alloy, thereby contributing to an improvement in the corrosion resistance.

Further, by setting the aluminum content of the ternary alloy suitably, the formability of the steel wire is improved, thereby making it possible to reduce the defective production ratio, e.g., in producing helical springs.

The aluminum content of the ternary alloy is preferably set to fall within a range of 10 to 30 weight percent. Within this range, the defective production ratio can be greatly reduced and the corrosion resistance can be improved.

According to the steel wire production method of the invention, a steel wire is firstly plated with zinc and secondly plated with zinc-aluminum, and the unsolidified zinc-aluminum layer is removed to expose the iron-zinc-aluminum ternary alloy on an outermost surface of the steel wire. Accordingly, the iron-zinc-aluminum alloy coated steel wire can be produced more easily.

Also, since the aluminum content in the zinc-aluminum molten bath is set at 2 to 5 weight percent, the aluminum content in the ternary alloy reaches the maximum level of 30 weight percent within a relatively short immersion time.

Further, since the unsolidified zinc-aluminum layer deposited on the outer surface of the steel wire is removed when the steel wire is pulled out of the zinc-aluminum molten bath, a redundant zinc-aluminum alloy in a melted-state is removed and only the iron-zinc-aluminum alloy remains on the surface of the steel wire. This ternary alloy acts to improve the formability and the corrosion resistance.

The steel wire is preferably drawn after the unsolidified zinc-aluminum layer depositing on the outer surface of the steel wire is removed. This steel wire has a high ductability, which enables a drawing to give a desired diameter to the steel wire without accompanying cracks and peeling off.

The above and other objects, features and advantages of the present invention will become more apparent upon a reading of the following detailed description in conjunction with the drawings.

DETAILED DESCRIPTION OF THE PREFERRED EMBODIMENTS OF THE INVENTION

Figure 1:
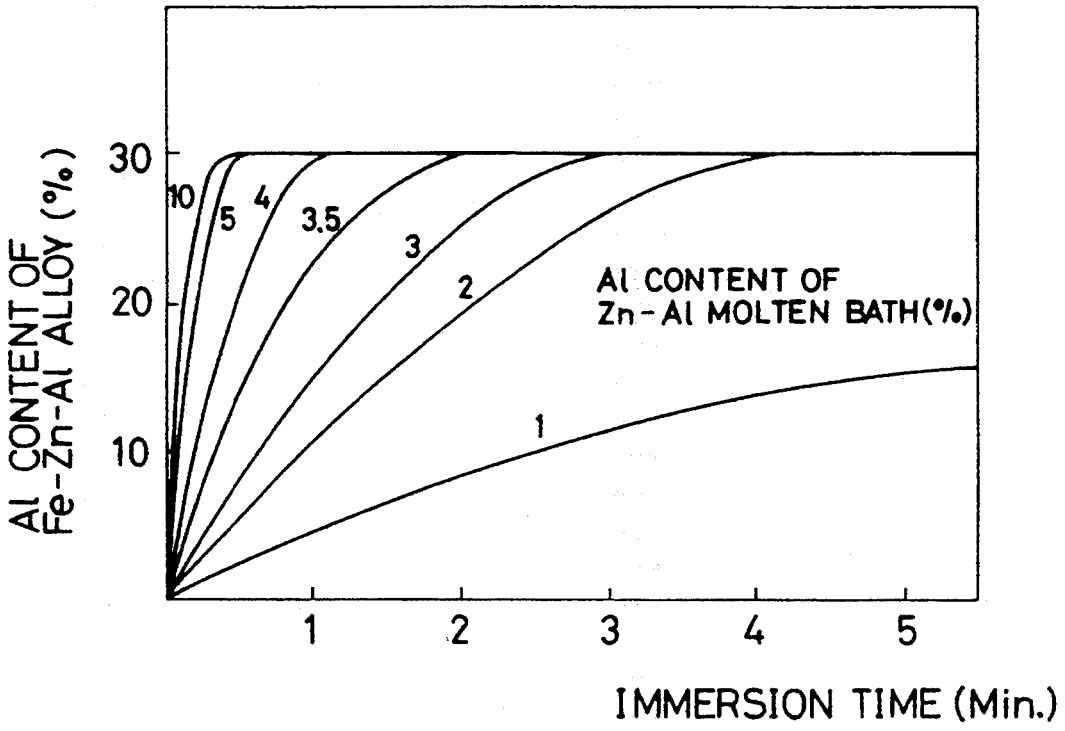
FIG. 1 is a graph showing a relationship between a time during which a steel wire formed with an iron-zinc alloy coating on the surface thereof is immersed in a zinc-aluminum molten bath and an aluminum content of the iron-zinc-aluminum alloy coating.

The present invention will be described with reference to the drawings. An alloy coated steel wire according to the invention is obtained basically by forming a ternary alloy coating of iron, zinc and aluminum on the outermost surface of a spring steel wire. To form such a ternary alloy coating on the surface of steel wire for spring, a basic steel wire is immersed in a zinc molten bath to form pure zinc layer on the surface of the steel wire and an iron-zinc alloy layer below the pure zinc layer. Thereafter, the wire is immersed in a zinc-aluminum molten bath containing 2 to 5 weight percent aluminum. An unsolidified zinc-aluminum layer deposited on the surface of the steel wire is removed when it is pulled out of the zinc-aluminum molten bath, so that only an iron-zinc-aluminum alloy layer remains on the surface. The steel wire is further drawn to produce an iron-zinc-aluminum alloy coated steel wire for spring which is excellent in formability and corrosion resistance.

Described below are a zinc plating step, a zinc-aluminum plating step, and an unsolidified zinc-aluminum layer removing step which are important to produce an alloy coated steel wire for spring of the invention.

ZINC PLATING STEP: A zinc plating is applied to a basic steel wire to form an iron-zinc alloy layer on an immediate surface thereof. Zinc plating may be accomplished by one of the usual methods widely used in the industry. For example, basic steel wire which has been descaled with acids and rinsed with water and passed through an ammonia chloride bath is immersed in a pure zinc molten bath and pulled therefrom, to thereby form an iron-zinc alloy layer on the immediate surface of the steel wire and above a zinc layer. The thickness of the alloy layer can be set desirably by adjusting suitably the temperature of the molten bath and the immersion time.

ZINC-ALUMINUM PLATING STEP: A zinc-aluminum plating is applied to the zinc plated steel wire obtained in the above-mentioned plating step. In this step, zinc and aluminum are heated at a temperature (e.g., at 435° C.) higher than 419° C. which is a melting point of zinc to prepare a zinc-aluminum molten bath. The zinc plated steel wire having the iron-zinc alloy layer formed on the immediate surface thereof are immersed in the zinc-aluminum molten bath for a specified time and pulled therefrom. In this way, zinc-aluminum plated steel wires can be obtained.

UNSOLIDIFIED ZINC-ALUMINUM LAYER REMOVING STEP: An unsolidified zinc-aluminum layer depositing on the surface of the zinc-aluminum plated steel wire is removed immediately after it is pulled out of the zinc-aluminum molten bath in the zinc-aluminum plating step. For example, this layer is wiped off using a thermal resistant plastic body such as an asbestos cloth.

The aluminum content of the zinc-aluminum molten bath is appropriate to set at 2 to 5 weight percent. If the aluminum content is smaller than 2 weight percent, it will be necessary to immerse the steel wire in the zinc-aluminum molten bath for a longer time. If the content is greater than 5 weight percent, aluminum is terribly oxidized in the zinc-aluminum molten bath due to excess of aluminum. As a result, aluminum dross is formed in great quantity, thereby hindering the fluidity in the molten bath.

When the zinc plated steel wire is immersed in the zinc-aluminum molten bath having 2 to 5 weight percent aluminum, the zinc layer on the surface of the steel wire melts immediately because the temperature in this molten bath is set higher than the melting point of zinc. Thus, the iron-zinc alloy layer formed during the zinc plating comes to direct contact with the zinc-aluminum molten bath. As time passes, aluminum diffuses into the iron-zinc alloy, with the result that an iron-zinc-aluminum alloy layer is formed on the immediate surface of the steel wire.

FIG. 1 shows a relationship between an aluminum content of the iron-zinc-aluminum alloy and an immersion time. In this graph, a horizontal axis represents the immersion time during which the steel wire having the iron-zinc alloy layer formed on the surface thereof is immersed in the zinc-aluminum molten bath, and a vertical axis represents the aluminum content of the formed ternary alloy. A curve in this graph represents the above relationship for each aluminum content of the zinc-aluminum molten bath, that is, 1, 2, 3, 3.5, 4, 5 and 10 weight percent.

As seen from this graph, the aluminum content of the ternary alloy does not increase greatly as time passes, in other words, an inclination of the curve is small when the aluminum content of the zinc-aluminum molten bath is 1 weight percent. For example, even if the steel wire is immersed for 5 minutes, the aluminum content of the ternary alloy is at most 15 weight percent. Thus, it is not economically practical to set the aluminum content in the zinc-aluminum molten bath at 1 weight percent.

Contrary to this, when the aluminum content of the zinc-aluminum molten bath is not smaller than 2 weight percent, the aluminum content of the ternary alloy reaches 30 weight percent, which is a saturation point, within about 0.5 to 3 minutes. When the aluminum content of the zinc-aluminum molten bath is not smaller than 5 weight percent, aluminum is oxidized exceedingly, with the result that the fluidity of the zinc-aluminum molten bath is hindered. Thus, it is better not to set the aluminum weight content of the molten bath not smaller than 5 weight percent. Further, it is not practical to set this content not smaller than 5 weight percent since the immersion time cannot be reduced very much by doing so, as is clear from FIG. 1.

Using various kinds of iron-zinc-aluminum alloy coated steel wires thus prepared, a number of helical springs were produced with the use of a generally used forming machine and the defective production ratio was calculated which is expressed in the number of defective helical springs per 100 helical springs produced.

Figure 2:
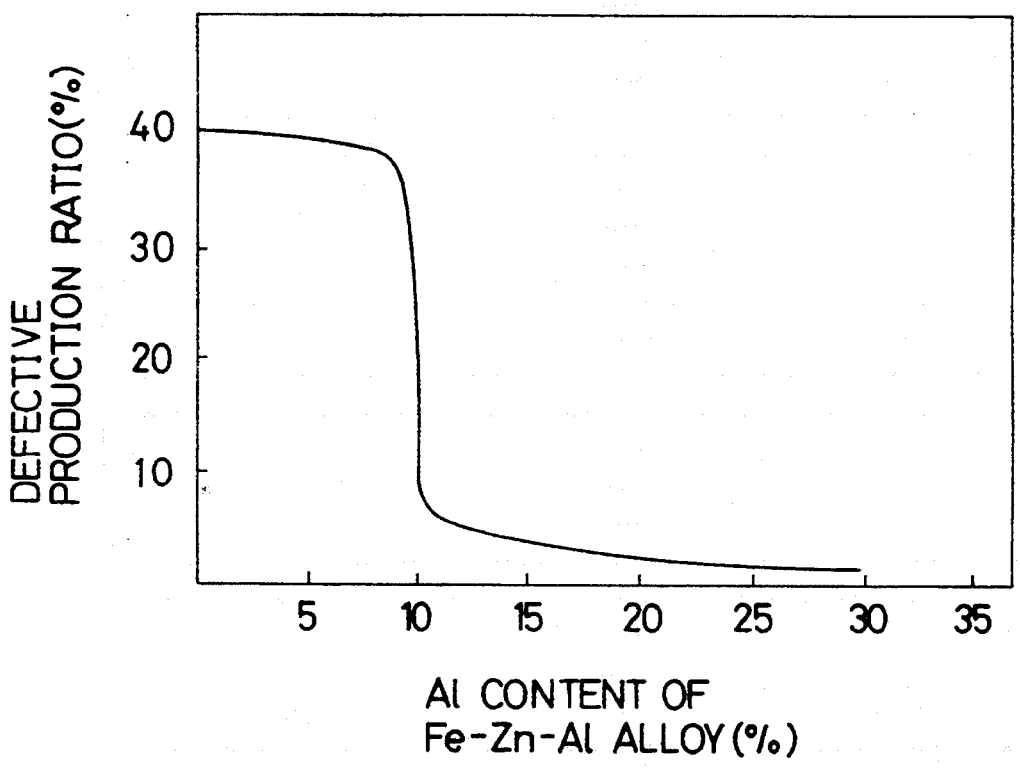
FIG. 2 is a graph showing a relationship between an aluminum content of an iron-zinc-aluminum alloy coating and a defective spring production ratio.

FIG. 2 is a graph showing a defective helical spring production ratio. A horizontal axis of this graph represents an aluminum content (weight percent) of the iron-zinc-aluminum alloy formed on the surface of the steel wire and a vertical axis represents a defective production ratio.

Compression springs were selected as sample helical springs. This is because these springs are required to have a large spring index D/d (D denotes the diameter of the helical spring while d denotes the diameter of the steel wire), a large spring pitch, and a large number of windings, and so compression springs are liable to develop defects. Accordingly, compression springs are easier for checking of defects. Specifically, a helical spring was selected which has a spring index of 30, spring pitch of 1.5 mm, and winding number of 30, and diameter of 1.0 mm.

As seen from the graph in FIG. 2, the defective spring production ratio is as high as about 40 percent when the aluminum content of the ternary alloy lies within a range of 0 to 10 weight percent. However, the detective production ratio falls drastically to 5 percent or smaller where the aluminum content is greater than 10 weight percent. The reason why the curve ends at the aluminum content of 30 weight percent is that aluminum does not diffuse into the iron-zinc alloy layer any further than that shown in FIG. 1.

As shown in FIG. 2, the defective spring production ratio changes drastically with 10 percent as a border. This is a quite new knowledge found as a result of the earnest research made by the inventors. The cause of the drastic change can be considered to be that the frictional property of the iron-zinc-aluminum alloy coating on the surface of the steel wire changes where the aluminum content of the iron-zinc-aluminum alloy is about 10 weight percent and that the frictional property improves suddenly when the aluminum content exceeds 10 weight percent, thereby reducing the friction coefficient with various machine tools for coiling.

Accordingly, to reduce the defective production ratio, it is preferable to set the aluminum content of the iron-zinc-aluminum alloy at 10 weight percent or greater. However, an upper limit is 30 weight percent.

Figure 3:
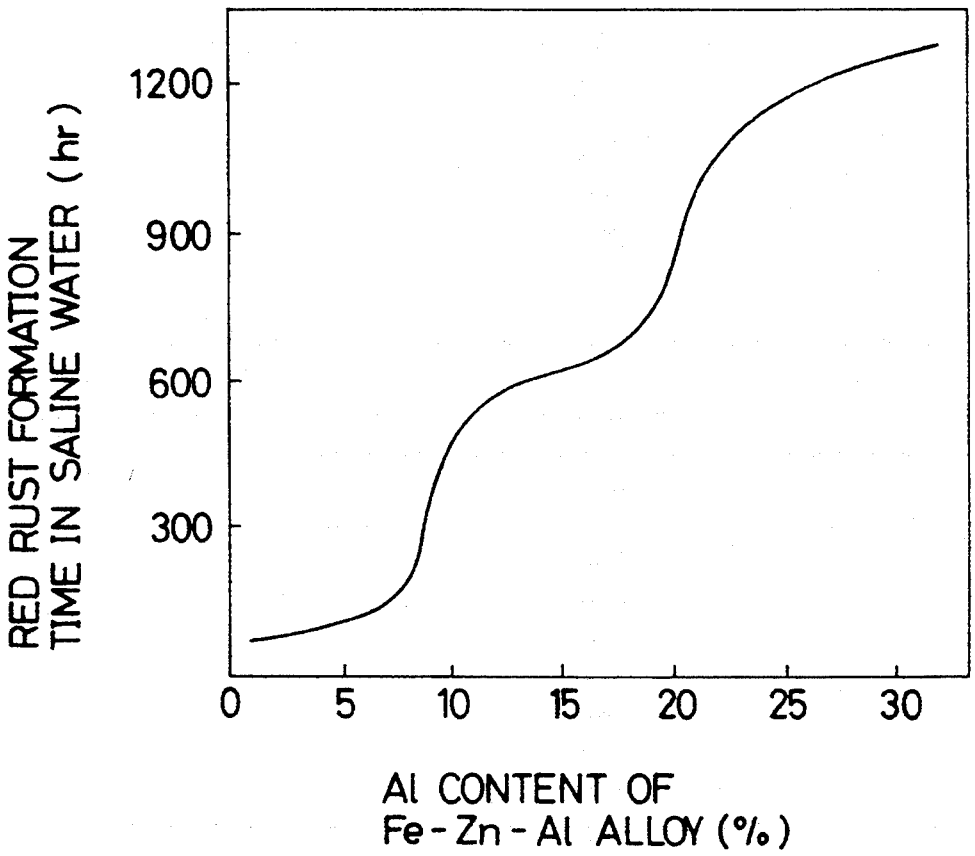
FIG. 3 is a graph showing a relationship between a time which lasts until an iron-zinc-aluminum alloy coated steel wire forms red rust after being immersed in 3 percent saline water and an aluminum content of the iron-zinc-aluminum alloy coating.

FIG. 3 is a graph showing a relationship between aluminum content of the iron-zinc-aluminum alloy and red rust formation time, during which time the steel wire is immersed in 3 percent saline water and forms red rust. Although a curve in this graph is winding, it can be seen that the red rust formation time is in proportion to the aluminum content of the ternary alloy. The slope of this curve becomes steeper particularly when the aluminum content of the ternary alloy is 10 weight percent or greater. From this, it can be seen that the more the aluminum content of the ternary alloy, the better the rust preventiveness.

The reason for this can be considered to be that as the aluminum content of the ternary alloy increases, the steel wire is more ready to form a fine aluminum hydroxide layer to cover satisfactorily the entire surface of the iron-zinc-aluminum alloy.

Next, characteristic performances of the invention will be described in detail by comparing a spring steel wire (Present Example) which was produced according to the invention with an AISI304 stainless steel wire for spring, zinc plated steel wire for spring, iron-zinc alloy coated steel wire for spring, high carbon steel wire for spring, and zinc-aluminum plated steel wire (Comparative Examples).

First, production of the Comparative Examples will be described. The AISI304 stainless steel wire for spring was produced by descaling an AISI304 stainless rod having a diameter of 5.5 mmo with acids, and drawing the stainless rod into a wire having a diameter of 3 mm with a continuous wire drawing machine. Thereafter, a solid solution annealing treatment was performed by loading and keeping the wire at 1150° C. for 3 minutes in a continuous bright annealing furnace employing ammonia cracked gas. The wire was then immersed in a nickel sulfamate molten bath, which has been frequently used to make the coiling work easily in the spring forming operation, so that a 3 μm thick nickel plating was formed on the surface of the wire. Consequently, the wire was drawn to a wire having a diameter of 1.0 mm, thereby being finished as the AISI304 stainless spring steel wire.

The zinc plated spring steel wire was produced as follows. A high carbon spring steel wire having a diameter of 5.5 mm and 0.82 weight percent carbon content was first descaled with acid, and drawn into a wire having a diameter of 3.5 mm with a continuous wire drawing machine. After being lead-patented at 550° C., the wire was again descaled with acid. Thereafter, the wire was drawn by the continuous wire drawing machine into a wire having a diameter of 1.1 mm. The drawn wire was immersed in a zinc molten bath kept at 440° C. to be plated with zinc. The zinc plated wire was drawn by a single wire drawing machine into a wire having a diameter of 1.0 mm, thereby being finished as the zinc plated steel wire for spring.

The iron-zinc alloy coated steel wire for spring was obtained as follows. The steel wire immersed in the zinc molten bath after being drawn to a diameter of 1.1 mm was pulled out of the zinc molten bath. The steel wire was immediately passed through an asbestos cloth fixed on a support column to mechanically remove redundant zinc from the surface of the steel wire. In this way, there was obtained a steel wire having an iron-zinc alloy coating. This steel wire was further skin-passed to have a diameter of 1.0 mm to produce the iron-zinc alloy coated steel wire for spring.

The high carbon steel wire for spring was obtained by descaling a high carbon spring steel wire having a diameter of 5.5 mm and 0.82 percent carbon with acid, drawing into a wire having a diameter of 3.5 mm with a continuous wire drawing machine, lead-patenting the drawn steel wire at 550° C., descaling the wire again with acid, and drawing the steel wire to have a diameter of 1.0 mm with the continuous wire drawing machine.

The zinc-aluminum plated wire was obtained as follows. A drawn high carbon steel wire was immersed in a zinc molten bath and plated with zinc. The zinc plated wire was immersed in a zinc-aluminum molten bath, and pulled out of the zinc-aluminum molten bath without being wiped by the asbestos cloth. Consequently, two layers were formed on the surface, an upper layer being an unsolidified zinc-aluminum layer and a lower layer being an iron-zinc-aluminum alloy. This wire was finally drawn to have a diameter of 1.0 mmo. For this wire, the aluminum content in the iron-zinc-aluminum alloy was set at 10 and 30 weight percent respectively. The aluminum content in the zinc-aluminum molten bath was set at 3.5 weight percent.

Next, production of the iron-zinc-aluminum alloy coated steel wire for spring of the invention will be described. Similarly to the production of the zinc plated steel wire for spring, a high carbon steel wire for spring having a diameter of 5.5 mm and 0.82 weight percent carbon content was descaled with acid, drawn to have a diameter of 3.5 mm with a continuous wire drawing machine, and lead-patented at 550° C. The wire was again descaled with acid, and drawn by the continuous wire drawing machine into a wire having a diameter of 1.1 mm. The drawn wire was immersed in a zinc molten bath kept at 440° C. to be plated with zinc.

The zinc plated wire was immersed in a zinc-aluminum molten bath at various linear velocities to form a zinc-aluminum alloy plating. The temperature of the zinc-aluminum molten bath was set at 435° C. There were prepared four types of zinc-aluminum molten baths whose aluminum content was 2, 3, 4, and 5 weight percent respectively.

The aluminum content of an iron-zinc-aluminum alloy is controlled by changing the linear velocity of a steel wire immersed in the zinc-aluminum molten bath. The linear velocity is regulated as follows. For example, in the ease of forming a ternary alloy having 20 weight percent aluminum in the zinc-aluminum molten bath having 3 weight percent aluminum, the linear velocity is regulated to obtain an immersion time of about 80 seconds as can be seen from FIG. 1.

By changing the linear velocity in consideration of the aluminum content of the different zinc-aluminum molten baths, four steel wires were formed with different iron-zinc-aluminum alloys having 5, 10, 20, and 30 weight percent aluminum respectively. The steel wires were wiped by an asbestos cloth immediately after being pulled out of the zinc-aluminum molten bath, and thereby redundant zinc-aluminum alloy depositing in a melted state on the surface of each steel wire was removed. Immediately thereafter, the resultant steel wires were drawn by a single wire drawing machine with the iron-zinc-aluminum alloy exposed on the outermost surface, so that the diameter thereof was 1.0 mm. In this way, the ternary alloy coated steel wires for spring were obtained.

An evaluation test was conducted for the AISI304 stainless steel wire for spring, zinc plated steel wire for spring, iron-zinc alloy coated steel wire for spring, high carbon steel wire for spring, zinc-aluminum alloy coated steel wire which were prepared as Comparative Examples and the iron-zinc-aluminum alloy coated steel wire for spring according to the invention. The contents of the evaluation test are as follows.

These steel wires for spring were formed into helical springs using a specified forming machine. These helical springs were: the outside diameter of sprig D=30 mm, the outside diameter of wire d=1 mm, the spring index (D/d)=30, the spring pitch=1.5 mm, and the number of winding=30. Since the spring pitch and the spring index are large, it will be seen that there is a large variation in the free length of spring and formed springs are liable to be defective. Thus, the comparison can be made easily.

Defective springs having a nonstandardized free length were picked up to calculate the defective spring production ratio. Three percent saline water was sprayed to the respective steel wires for spring and the time required for the steel wire for spring to gather red rust was measured. The steel wires for spring were evaluated in this manner. Test conditions and results are as shown in Tables 1-A and 1-B respectively.

TABLE 1-A

| | (TEST CONDITION) | | | |
|---|---|---|---|---|
| | Al CONTENT (%) | STATE OF SURFACE | THICKNESS OF PLATE (μm) | DIAMETER OF WIRE (mm) |
| PRESENT EX. | | | | |
| Fe—Zn—Al COATED STEEL WIRE | 10 | Fe—Zn—Al COAT | 10 | 1.0 |
| | 20 | Fe—Zn—Al COAT | 10 | 1.0 |
| | 30 | Fe—Zn—Al COAT | 10 | 1.0 |
| COMPARATIVE EXS. | | | | |

TABLE 1-A-continued

| | (TEST CONDITION) | | | |
|---|---|---|---|---|
| | Al CONTENT (%) | STATE OF SURFACE | THICKNESS OF PLATE (μm) | DIAMETER OF WIRE (mm) |
| AISI304 STAINLESS STEEL WIRE | — | NO DEPOSIT & COAT | — | 1.0 |
| Zn PLATED STEEL WIRE | — | Zn DEPOSIT Fe—Zn COAT | 30 | 1.0 |
| Fe—Zn COATED STEEL WIRE | — | Fe—Zn COAT | 5 | 1.0 |
| HIGH CARBON STEEL WIRE | — | NO DEPOSIT & COAT | — | 1.0 |
| Zn—Al PLATED STEEL WIRE | 10 | ZN—Al DEPO & Fe—Zn—Al | 40 | 1.0 |
| | 30 | ZN—AI DEPO & Fe—Zn—Al | 40 | 1.0 |

TABLE 1-B

| | (TEST RESULT) | | | | |
|---|---|---|---|---|---|
| | Al CONTENT (%) | CRACK | TENSILE STRENGTH (kgf/mm) | DEFECT RATIO (%) | RED RUST (hr) |
| PRESENT EX. | | | | | |
| Fe-Zn-Al COATED STEEL WIRE | 10 | NO | 184 | 5 | 450 |
| | 20 | NO | 183 | 3 | 800 |
| | 30 | NO | 185 | 2 | 1400 |
| COMPARATIVE EXS. | | | | | |
| AISI304 STAINLESS STEEL WIRE | — | — | 202 | 57 | 210 |
| Zn PLATED STEEL WIRE | — | YES | 182 | 45 | 185 |
| Fe-Zn COATED STEEL WIRE | — | YES | 189 | 20 | 14 |
| HIGH CARBON STEEL WIRE | — | — | 191 | 25 | 10 |
| Zn-Al PLATED STEEL WIRE | 10 | NO | 179 | 48 | 1800 |
| | 30 | NO | 177 | 44 | 1700 |

As seen from these Tables, the defective spring production ratio of the spring steel wire according to the invention is very low, namely, 2 to 5 percent even if the aluminum content in the iron-zinc-aluminum alloy changes to 10, 20, and 30 weight percent so long as it is 10 weight percent or greater. On the contrary, the defective spring production ratio of the spring steel wires as Comparative Examples is very high, namely, 20 to 57 percent. Hence, it can be seen that the spring steel wire according to the invention is excellent in reducing the defective spring production ratio.

The red rust gathering time of the spring steel wire according to the invention is 450 to 1400 hours, whereas that of the Comparative Examples except the zinc-aluminum plated steel wire is 10 to 210 hours. Thus, it can be seen that the spring steel wire according to the invention is also excellent in the corrosion resistance. The zinc-aluminum plated steel wire has a red rust gathering time of 1700 to 1800 hours and therefore has a good corrosion resistance. However, the defective spring production ratio is as bad as 44 to 48 percent and thus the overall evaluation is not satisfactory.

Further, the crack caused by the drawing treatment was not recognized in the spring steel wire according to the invention. Contrary to this, cracks were recognized in the Comparative Examples. In this respect as well, the spring steel wire according to the invention are better than the other spring steel wires.

In the foregoing example, the zinc plated spring steel wire having a diameter of 1.1 mmø was zinc-aluminum plated, and the iron-zinc-aluminum alloy coated spring steel wire was produced. The produced steel wire for spring was then drawn to have a diameter of 1.0 mmø, thereby being finished as an iron-zinc-aluminum alloy coated steel wire for spring. This is only an example. Alternatively, a steel wire for spring having a diameter of 3.5 mmø may be zinc-plated: immersed in a zinc-aluminum molten bath; pulled out of the molten bath with being wiped by asbestos cloth to obtain an iron-zinc-aluminum alloy coated spring steel wire; and drawn to have a diameter of 1.0 mmø to be finished as a steel wire for spring. Thus obtained steel wire for spring demonstrates the same effect as the one obtained in the foregoing example.

What is claimed is:

1. A method for producing a steel wire for spring, comprising the steps of:

immersing a steel wire in a zinc molten bath to plate the steel wire with zinc;

immersing the zinc-plated steel wire in a zinc-aluminum molten bath containing 2 to 5 weight percent aluminum to form a ternary alloy of iron, zinc, and aluminum on a surface of the steel wire, said aluminum being present in said ternary alloy at a concentration greater than 10 weight percent; and removing an unsolidified zinc-aluminum layer deposited on the outer surfaces of the zinc-plated steel wire while being taken out of the zinc-aluminum molten bath to expose the ternary alloy on an outermost surface of the steel wire.

2. A method as defined in claim 1 wherein the unsolidified zinc-aluminum layer is removed by wiping off the unsolidified zinc-aluminum layer with asbestos cloth.

3. A method as defined in claim 1 further comprising drawing the ternary alloy coated steel wire into a thinner wire having a specified diameter after the unsolidified zinc-aluminum layer is removed.

4. A method as defined in claim 3 further comprising drawing the zinc-plated steel wire into a thinner wire having specified diameter before the zinc-plated steel wire is immersed in the zinc-aluminum molten bath.

* * * * *